US006886373B2

(12) United States Patent
Carrubba et al.

(10) Patent No.: US 6,886,373 B2
(45) Date of Patent: May 3, 2005

(54) GARMENT STEAMER

(75) Inventors: Paul J. Carrubba, Baldwin, NY (US); Vito James Carlucci, Stratford, CT (US); Kam Fai Fung, Hong Kong (CN)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 10/243,054

(22) Filed: Sep. 13, 2002

(65) Prior Publication Data

US 2004/0050118 A1 Mar. 18, 2004

(51) Int. Cl.[7] ..... D06C 7/00
(52) U.S. Cl. ..... 68/222; 68/5 R; 8/149.3
(58) Field of Search ..... 68/222, 5 R; 8/149.3

(56) References Cited

U.S. PATENT DOCUMENTS

| | | | | |
|---|---|---|---|---|
| 3,559,427 | A | 2/1971 | Baker | |
| 3,581,529 | A | 6/1971 | Mitchell | |
| 3,646,317 | A | 2/1972 | Osrow | |
| 3,675,449 | A | 7/1972 | Bluestein | |
| 4,426,857 | A | 1/1984 | Epstein | |
| 4,485,519 | A | * 12/1984 | Collier | 15/359 |
| 4,810,854 | A | 3/1989 | Jurisich et al. | |
| 4,875,249 | A | * 10/1989 | Collier | 15/398 |
| D319,121 | S | 8/1991 | Muller | |
| 5,123,266 | A | 6/1992 | Tabraham | |
| 5,609,047 | A | 3/1997 | Hellman, Jr. et al. | |
| 5,611,868 | A | * 3/1997 | Gurstein et al. | 134/21 |
| D421,165 | S | 2/2000 | Joiner et al. | |
| 6,031,969 | A | 2/2000 | Burr et al. | |
| D423,156 | S | 4/2000 | Joiner et al. | |
| 6,061,935 | A | 5/2000 | Lee | |
| D426,924 | S | 6/2000 | Joiner et al. | |
| 2002/0154011 | A1 | * 10/2002 | Pasin et al. | 340/540 |

FOREIGN PATENT DOCUMENTS

| | | | |
|---|---|---|---|
| EP | 0290269 | 7/1929 | |
| EP | 0079866 | 5/1983 | |
| EP | 1215330 A1 | * 6/2002 | D06F/73/02 |

OTHER PUBLICATIONS

International Search Report dated Sep. 24, 2004.

* cited by examiner

*Primary Examiner*—Alexander Markoff
(74) *Attorney, Agent, or Firm*—Ohlandt, Greeley, Ruggiero & Perle LLP

(57) ABSTRACT

There is provided a garment steamer for domestic use that cooperates with a variety of different attachments to provide a variety of different steam or vapor emitting effects. The garment steamer also has an ionic and/or ozone generating/emitting feature to facilitate neutralizing odor and removing undesirable particulate from a garment. The garment steamer may also have a hanger and rod assembly in which a collapsible hanger selectively cooperates with a telescopic rod, which is connected to a base, such that the hanger can be selectively positioned at any location along the height of the rod and/or disengaged from the rod. The garment steamer also includes a fluid heating assembly enclosed in the base, a separable fluid container in separable fluid communication with the fluid heating assembly, and a separable hose in separable fluid communication with the fluid heating assembly, as well as with the variety of different attachments.

15 Claims, 7 Drawing Sheets

1
52
50
53
40
51
41
17
15
40
20
14
10
22
11
12
19
18
16
16

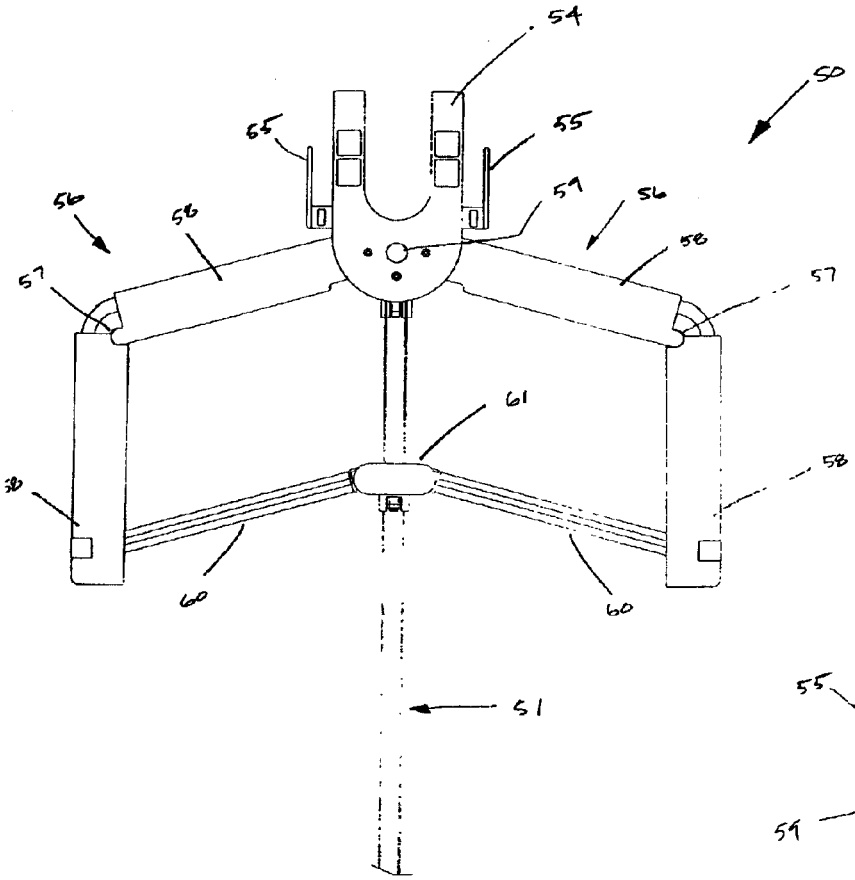
FIG. 5
FIG. 6
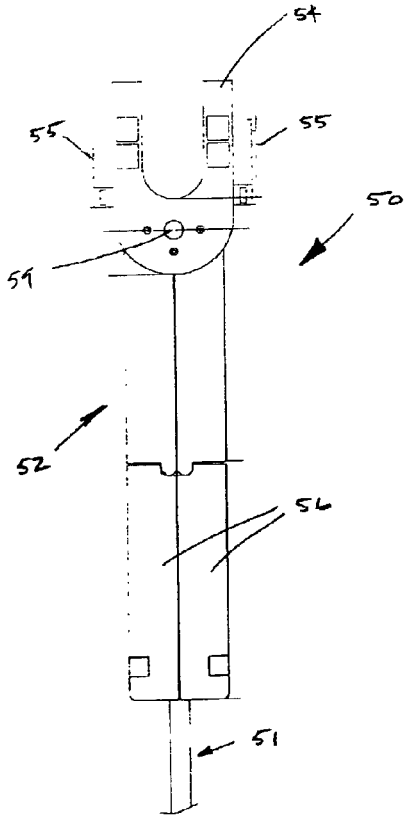

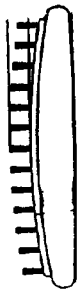
FIG. 18
FIG. 19
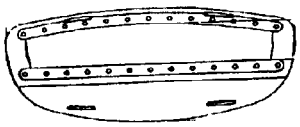
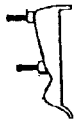
FIG. 17
FIG. 21
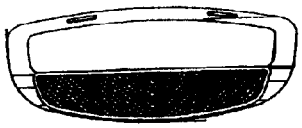
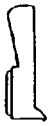
FIG. 20
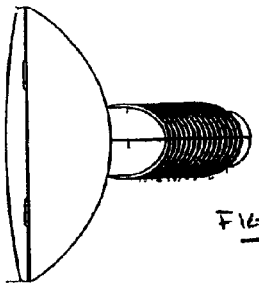
FIG. 15
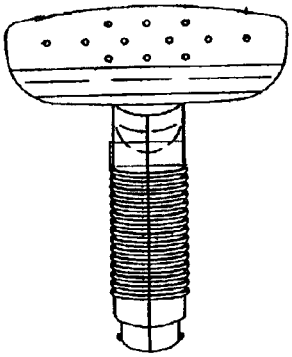
FIG. 16
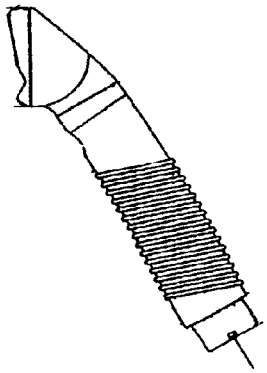
FIG. 14

GARMENT STEAMER

BACKGROUND OF THE INVENTION

1. Field of the Invention

The present invention relates to a garment steamer. More particularly, the present invention relates to a transportable garment steamer providing improved efficiency, effectiveness and convenience in use.

2. Description of the Prior Art

Garment steamers for use in the home are well known. For example, U.S. Pat. No. 5,609,047, U.S. Pat. No. 5,123,266, U.S. Pat. No. 4,426,857 and EP 0 079 866 each disclose a different variation on such a device.

None of the above, provide for a garment steamer that cooperates with a variety of different attachments to create a variety of different steam or vapor emitting effects, generates/emits a concentration of ions and/or ozone, and has a variety of other advantageous features. Such features include a collapsible/telescopic hanger/rod assembly, a separable fluid container, a separable insulated hose, as well as various safety features for improving safety in use. Thus, there is a need for a portable home garment steamer having the aforementioned features to provide greater flexibility, convenience, and efficiency in use. Also, preferably the steamer has a body that is sleek, compact, lightweight, and easily transportable.

SUMMARY OF THE INVENTION

It is an object of the present invention to provide a garment steamer for use in a home.

It is another object of the present invention to provide such a garment steamer that is sleek, compact and lightweight.

It is still another object of the present invention to provide such a garment steamer that improves flexibility and efficiency in use.

It is yet another object of the present invention to provide such a garment steamer that cooperates with a variety of different attachments for producing a variety of different steam or vapor emitting effects.

It is a further object of the present invention to provide such a garment steamer that has a selectively adjustable and collapsible telescopic hanger/rod assembly.

It is still a further object of the present invention to provide such a garment steamer that has an ion and/or ozone generating/emitting feature.

These and other objects and advantages of the present invention are achieved by a garment steamer having a housing or base, a separable fluid container in separable fluid communication with a fluid heating assembly, a fluid heating assembly, a separable hose in separable fluid communication with the fluid heating assembly as well as with a variety of attachments, an adjustable and collapsible telescopic hanger/rod assembly, and at least one ion/ozone generator/emitter assembly.

BRIEF DESCRIPTION OF THE DRAWINGS

The present invention is more fully understood by reference to the following detailed description of an illustrative embodiment in combination with the drawings identified below.

FIG. 5 is a first view of a collapsible hanger for cooperating with the garment steamer of FIG. 1, showing the hanger in an extended or open position;

FIG. 6 is a second view of the collapsible hanger of FIG. 5, showing the hanger in a collapsed or closed position;

FIG. 14 is a side view of a nozzle attachment for cooperating with the garment steamer of FIG. 1;

FIG. 15 is a top view of the nozzle attachment of FIG. 14;

FIG. 16 is an end view of the nozzle attachment of FIG. 14;

FIG. 17 is a side view of a brush accessory for cooperating with the nozzle attachment of FIG. 14;

FIG. 18 is a top view of the brush accessory of FIG. 17;

FIG. 19 is an end view of the brush accessory of FIG. 17;

FIG. 20 is a side view of a fluff accessory for cooperating with the nozzle attachment of FIG. 14; and FIG. 21 is an end view of the fluff accessory of FIG. 20.

DETAILED DESCRIPTION OF THE INVENTION

Figure 1:
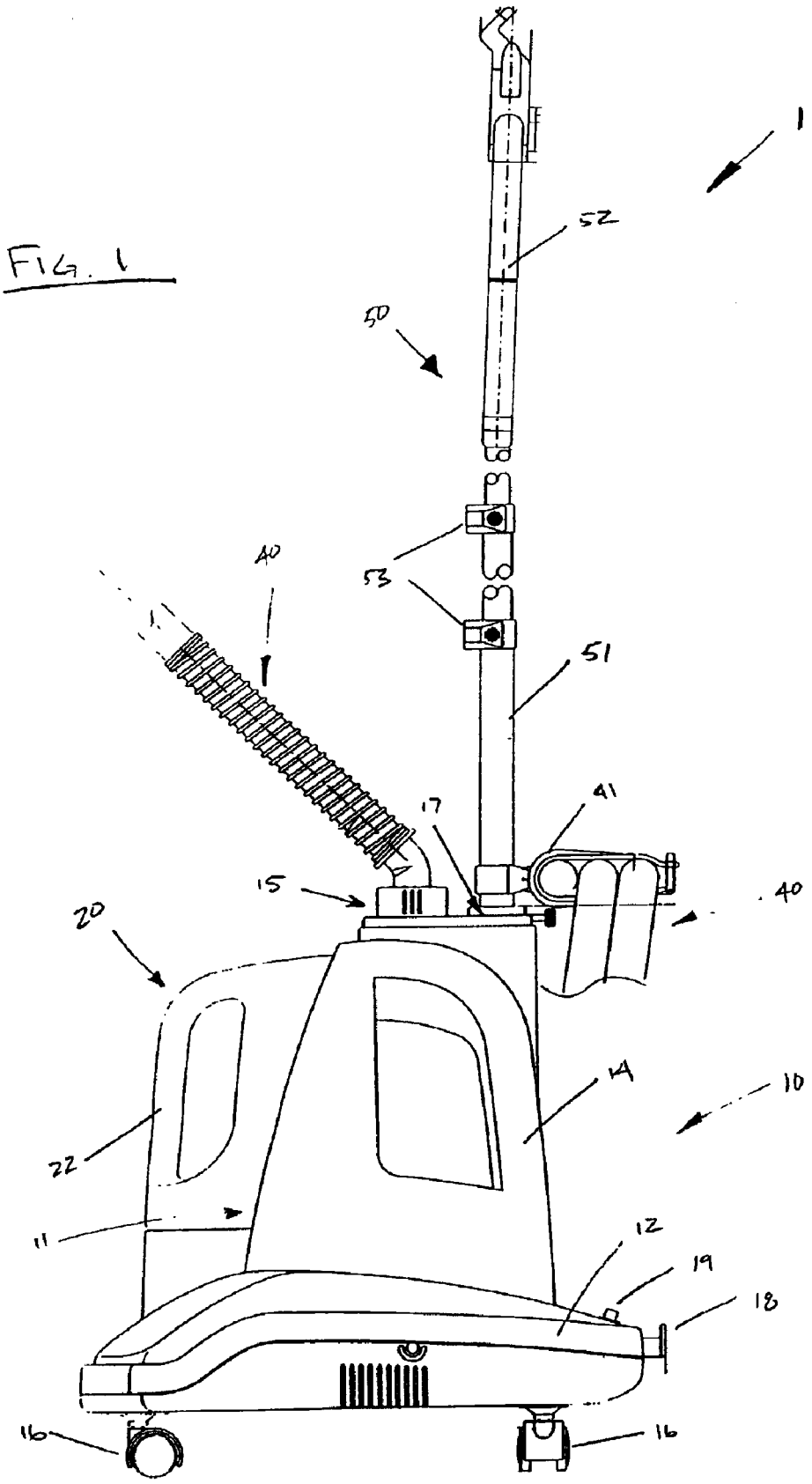
FIG. 1 is a side view of the garment steamer in accordance with an illustrative embodiment of the present invention.
Figure 2:
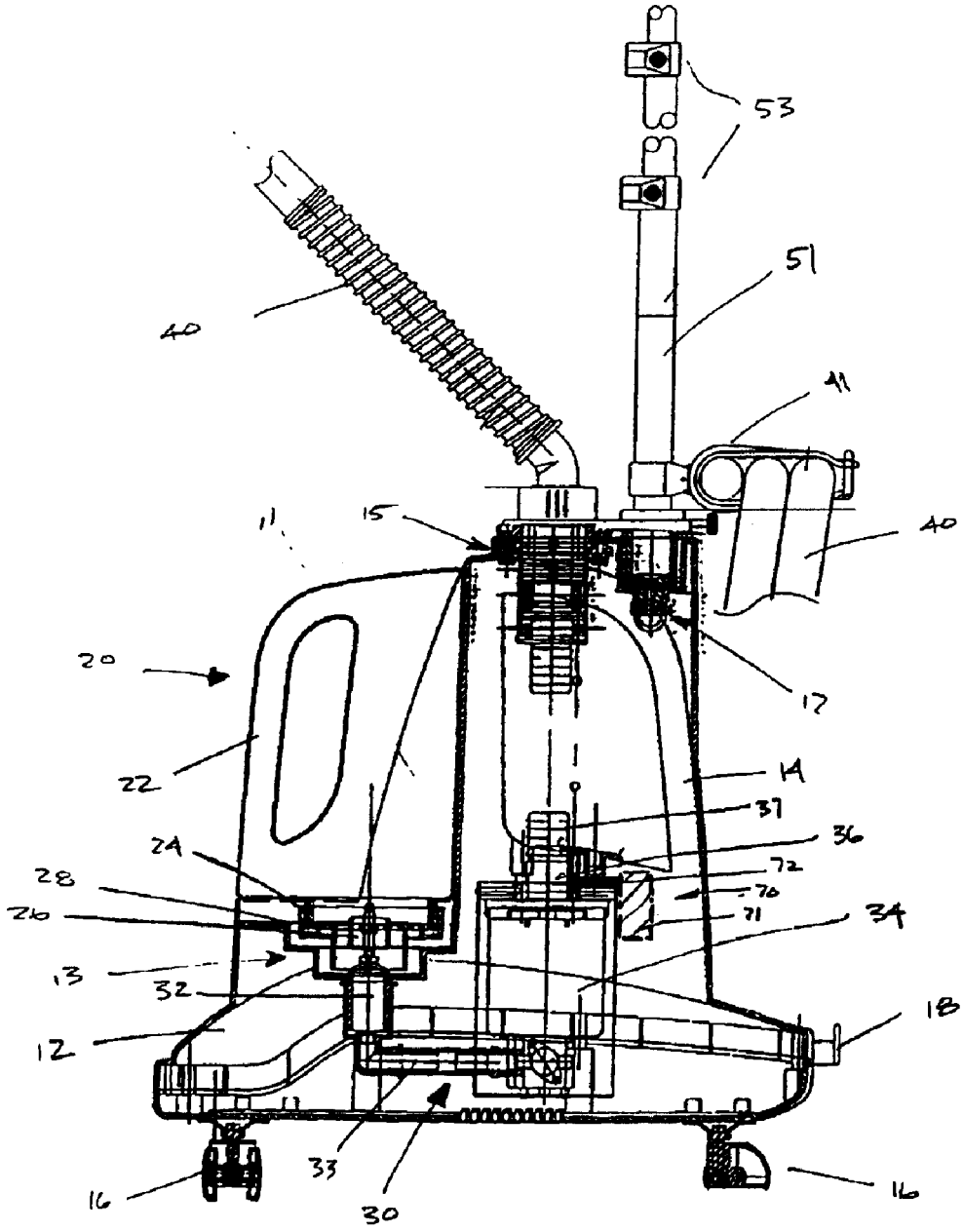
FIG. 2 is a side partially sectional view of the garment steamer of FIG. 1.

Referring to the drawings and in particular, FIGS. 1 and 2, there is shown a garment steamer in accordance with an illustrative embodiment of the present invention generally represented by reference numeral 1. Garment steamer 1 has a housing or base 10, a fluid container 20, a fluid heating assembly 30, a hose 40, a hanger/rod assembly 50, and at least one ion/ozone generator/emitter assembly 70. Preferably, garment steamer 1 cooperates with a variety of different attachments 80 to provide a variety of different steaming or vaporizing effects.

Preferably, base 10 has a wide relatively flat lower portion 12 and a tall relatively cylindrical upper portion 14 configured to distribute the weight of steamer 1 such that the center of gravity thereof is lowered closer to the ground thereby improving the overall stability of the device. Also preferably, lower portion 12 and upper portion 14 each enclose a portion of fluid heating assembly 30.

Lower portion 12 preferably has a number of transport structures 16 mounted to a bottom surface thereof. Preferably, transport structures 16 have at least four lightweight wheels made preferably of a durable plastic material. However, transport structures 16 can be of any type known to facilitate easy transport of steamer 1. Lower portion 12 preferably also has a cord reel (not shown) for selectively retaining or storing a power chord (not shown). Alternatively, lower portion 12 can have a cord wrap 18 that allows a user to wrap and store a power cord (also not shown). In addition, lower portion 12 preferably has a control 19 disposed thereon for controlling one or more operative functions, including powering the device. Control 19 can be of any type known and sufficient to provide the user with effective access and easy use.

Upper portion 14 preferably is centrally disposed above lower portion 12. Upper portion 14 preferably has a recess 11 with a first connector 13 for receiving fluid container 20 and connecting fluid container 20 to fluid heating assembly 30, a second connector 15 for connecting fluid heating assembly 30 to hose 40, and a third connector 17 for connecting hanger/rod assembly 50.

Figure 3:
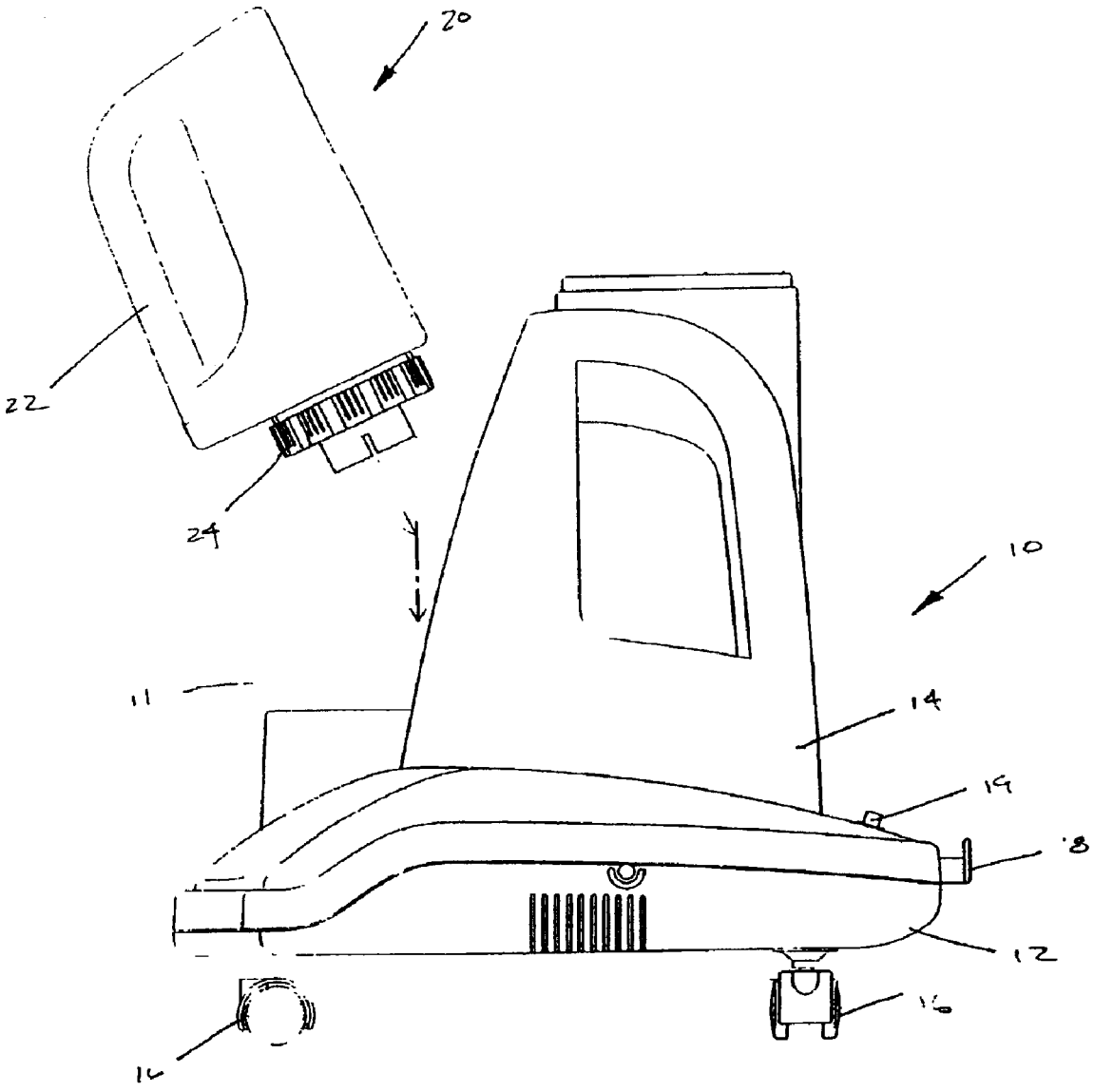
FIG. 3 is a side view of the garment steamer of FIG. 1, showing the fluid container separated from the base.

Referring to FIGS. 2 and 3, fluid container 20 preferably can be removed or separated from recess 11. Fluid container 20 preferably has a handle 22 and a cap 24. Handle 22 preferably enables the user to easily manage or cope with fluid container 20 as he/she selectively connects and/or separates the fluid container to and from recess 11. In the illustrative embodiment shown in FIG. 3, cap 24 preferably is removable to allow the user to add fluid into fluid container 20 when the container is separated from recess 11. Cap 24 preferably also has a spring valve 26 and an air vent 28. Spring valve 26 can release when fluid container 20 has a volume of fluid therein and is placed into recess 11 such that cap 24 is in fluid communication with fluid heating assembly 30 via first connector 13. The release of spring valve 26 allows gravity to force the fluid in fluid container 20 into fluid heating assembly 30. Air vent 28 preferably prevents a vacuum from being created to ensure that the fluid can flow until an equilibrium point is reached with respect to the fluid position between fluid container 20 and fluid heating assembly 30. Once the equilibrium point is reached, the fluid stops flowing.

Referring to FIG. 2, fluid heating assembly 30 preferably is centrally disposed in base 10 and has a fluid inlet 32 located in lower portion 12 of base 10, a boiler 34, and a fluid outlet 36 located in upper portion 14 of base 10. Fluid inlet 32 preferably has a first tube 33 connecting boiler 34 and first connector 13 so that the first connector is in separable or releasable fluid communication with fluid container 20. Boiler 34 preferably is die-cast and produces steam or vapor within a relatively short period of time (i.e. about 1 to about 2 minutes). Fluid outlet 36 preferably has a second tube 37 connecting boiler 34 to second connector 15 so that the second connector is in separable or releasable fluid communication with hose 40.

Figure 4:
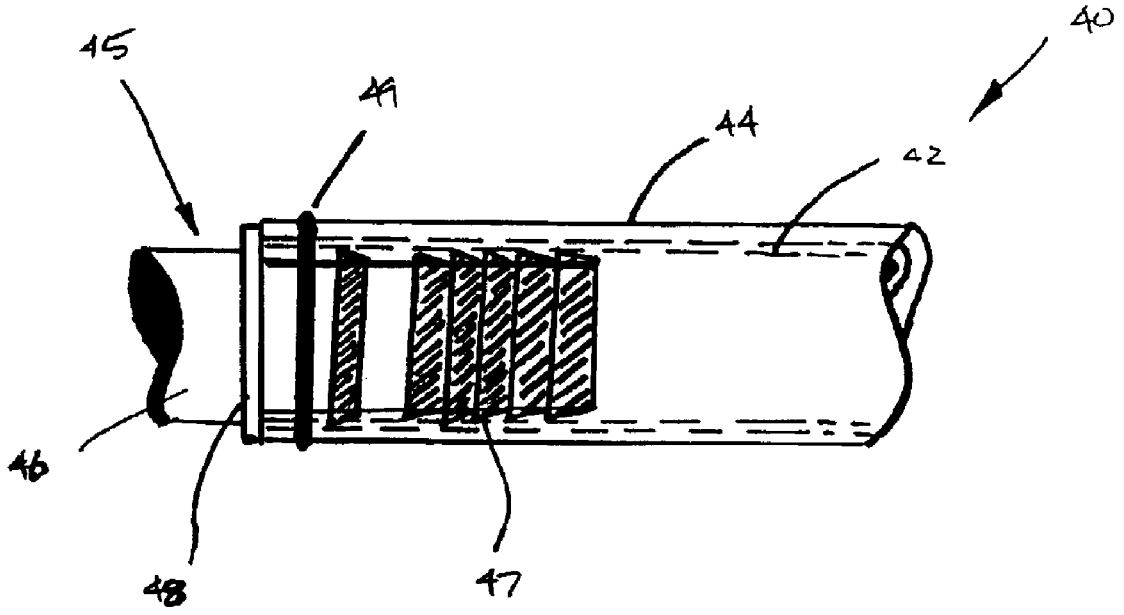
FIG. 4 is a side section view of an illustrative adapter-hose connection.

Referring to FIG. 4, hose 40 is preferably an insulated hose that can be removably or separably connected to second connector 15 shown in FIG. 1. Preferably hose 40 is flexible and has at least an inner tube 42 and an outer tube 44 surrounding inner tube 42. Inner tube 42 preferably facilitates thermal retention as well as fluid flow. Inner tube 42 can also preferably be formed of any suitable material for conducting heated steam or vapor. Outer tube 44 preferably provides a layer of insulation that improves thermal efficiency and increases safety in user handling. Preferably, hose 40 has an adapter 45 at each end thereof for selectively cooperating with second connector 15 and/or the variety of different attachments 80. Preferably, adapter 45 has a tubular hollow shaft 46 with a number of annular ribs or barbs 47 and an abutment 48 disposed thereon. Barbs 47 and abutment 48 cooperate with the ends of hose 40 and a fastener 49 to frictionally connect adapter 45, inner tube 42, and outer tube 44. It is noted that various other known connector assemblies may also be employed to accomplish the purpose of securely sealing and connecting hose 40 with the variety of different attachments 80 and second connector 15, thereby providing fluid communication between heating assembly 30 and the variety of attachments. Thus, preferably when fluid container 20 is filled with fluid and placed in recess 11 such that cap 24 engages first connector 13, fluid can flow through fluid inlet 32 and into boiler 34 to be rapidly heated or vaporized, which vapor is conveyed through fluid outlet 36 into hose 40 and out one of the variety of attachments 80. Accordingly, the user is able to direct, manipulate or control the intensity and/or emission of the vapor to provide a variety of different steaming or vaporizing effects.

Referring to FIGS. 5 and 6, in one embodiment of the present invention, garment steamer 1 preferably cooperates with hanger/rod assembly 50 to support or hold garments during the steaming process. Hanger/rod assembly 50 is preferably selectively telescopically adjustable and collapsible. Preferably, assembly 50 has a rod 51 telescopically connected to base 10 and a hanger 52, connected, preferably integrally to rod 51 to collapsibly cooperate therewith. Preferably, rod 51 is telescopically received and retained in base 10 and can have a number of locks 53 to allow the rod 51 to be securely fixed at a variety of different vertical positions. Also, rod 51 can cooperate with a hose retaining mechanism 41 for storing hose 40 when not in use. Further, rod 51 can be separably connected to base 10 and can have a selectively collapsible tripod or stand (not shown) connected or integral therewith. The collapsible stand preferably cooperates with rod 51 to allow the rod to both stand alone, separate from base 10, and to be selectively received, supported and/or retained by the base. Thus, base 10 can serve as a holder and/or as a storage container for rod 51 when not in use.

Preferably, hanger 52 has an upper support or hub 54, shown clearly in FIGS. 5 and 6, having one or more hanging supports 55. Hanger 52 also preferably has at least two arms 56 pivotally connected to hub 54. Each arm 56 has at least one hinge 57 pivotally connecting at least two beams 58. Further, hanger 52 preferably has a lock/release button 59 for selectively positioning and securing arms 56 in a number of different positions to accommodate different types of garments. Still further, hanger 52 has at least two ribs 60 for cooperating with a slider 61, which is slidable along rod 51, to facilitate accomplishing the selective positioning of arms 56. Also, hanger 52, in addition to being connected, and preferably integral with rod 51, can be selectively separable therefrom. This creates a greater flexibility in use, enabling the user to separably hang or support a garment on a wall or door. Also preferably, hanger 52 can be slidable along rod 51 such that the hanger can be selectively and securely positioned at any point along the rod.

Referring to FIG. 2, in another embodiment of the present invention, garment steamer 1 preferably cooperates with an ion and/or ozone assembly 70 to infuse a garment with odor-neutralizing ions and/or ozone. Preferably, assembly 70 has one or more ion and/or ozone generator(s) 71 and one or more ion and/or ozone emitter(s) 72 operatively connected with the one ion and/or ozone generator(s). However, it is noted that ion and/or ozone assembly 70 can be any device or system capable of generating and/or emitting ions and/or ozone, such as for example, an ultraviolet (UV) light source (not shown). Preferably, the ion and/or ozone generator 71 and the ion and/or ozone emitter 72 can be positioned at any location in relation to garment steamer 1, suitable to optimize the effective operation thereof. The ion and/or ozone generator 71 can be any device suitable for adjustably generating voltage outputs of varying intensity and/or polarity as well as different combinations thereof. The ion and/or ozone emitter 72 can have any configuration suitable to conform to the arrangement and operation of garment steamer 1. For example, the ion and/or ozone emitter 72 can be a conductive needle, a conductive plate or any other like structure. Further, the ion and/or ozone emitter 72 can be formed of any material suitable to effectively emit ions and/or ozone as well as to conform to the constraints associated the arrangement and/or operation of the garment steamer 1. Examples of materials that might be used include, for example, conductive metal, conductive polymer, carbon material, or silicon based material. It is noted that the ion and/or ozone generator 71 and the ion and/or ozone emitter 72 are preferably configured for safety, as well as protection from damage caused by extensive and prolonged use.

Figure 8:
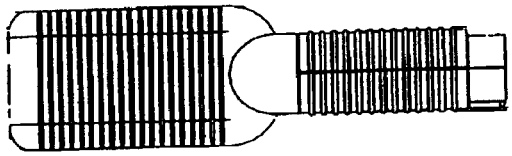
FIG. 8 is a top view of the straightening attachment of FIG. 7.
Figure 9:
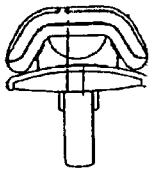
FIG. 9 is an end view of the straightening attachment of FIG. 7.
Figure 7:
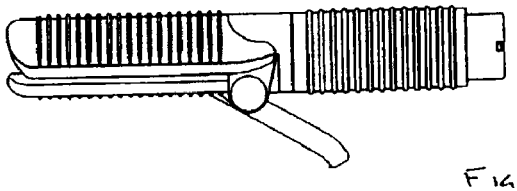
FIG. 7 is a side view of a straightening attachment for cooperating with the garment steamer of FIG. 1.
Figure 11:
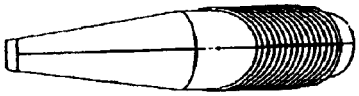
FIG. 11 is a top view of the concentrating attachment of FIG. 10.
Figure 12:
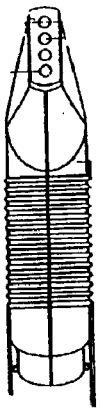
FIG. 12 is an end view of the concentrating attachment of FIG. 10.
Figure 10:
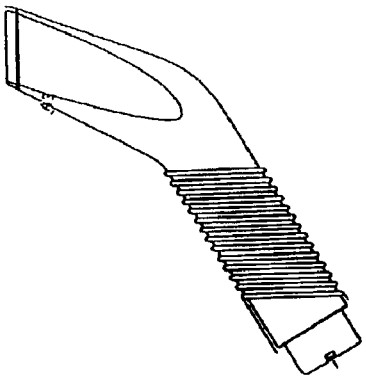
FIG. 10 is a side view of a concentrating attachment for cooperating with the garment steamer of FIG. 1.
Figure 13:
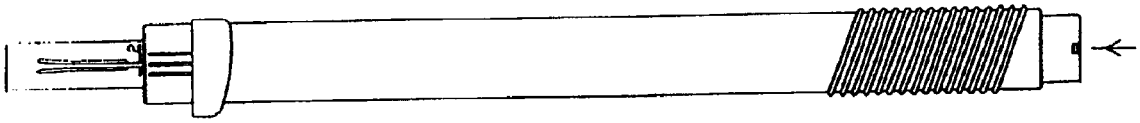
FIG. 13 is a side view of a wand attachment for cooperating with the garment steamer of FIG. 1.

It is noted that the variety of different attachments 80, which cooperate with garment steamer 1, to provide a variety of different steaming or vaporizing effects, can preferably be of any type suitable for effective use with heated vapor. For example, these attachments 80 may be a straightening attachment, as shown in FIGS. 7 through 9, a concentrator attachment, as shown in FIGS. 10 through 12, a wand attachment, as shown in FIG. 13, and a nozzle attachment, as shown in FIGS. 14 through 16. It is further noted that each of the variety of different attachments 80 can be configured to selectively cooperate with a variety of different accessory parts. For example, a brush accessory, as shown in FIGS. 17 through 19, or a fluff accessory, as shown in FIGS. 20 and 21. Thus, the accessory parts provide greater flexibility and efficiency in use.

Having identified and described the preferred embodiments of the present invention, it is appreciated that details may be modified in a variety of ways and that alternative embodiments are also within the scope of the present invention. For example, it is possible to provide at least one of the variety of different attachments 80, shown in FIGS. 7 through 16 and/or accessory parts shown in FIGS. 17 through 21, with an ion and/or ozone generator and a corresponding ion and/or ozone emitter (not shown), having at least each of the attributes previously preferably described with respect to each. In this alternative embodiment, the ion and/or ozone emitter is preferably situated to effectively infuse or introduce ions and/or ozone into a garment. This introduction of ions and/or ozone into a garment has an odor-neutralizing effect and thus facilitates in the removal of lingering odors from various garments and fabrics. It is noted that the ion and/or ozone emitter can preferably be located in a selectively removable protective casing (not shown) thus preserving the integrity of the ion and/or ozone emitter and allowing selective access thereto, for cleaning and/or replacement thereof.

In another example, it is preferably possible to situate an ion and/or ozone generator and a corresponding ion and/or ozone emitter (not shown), having at least the attributes previously preferably described with respect to each, in base 10 proximate fluid outlet 36. In this embodiment, the ion and/or ozone emitter is preferably situated to effectively infuse or introduce ions and/or ozone into the vaporized fluid exiting fluid outlet 36. It is noted that infusing the vaporized fluid with ions and/or ozone can have a beneficial cleansing effect thereon to reduce the build up of dust and other debris, thereby improving efficiency and effectiveness of garment steamer 1 as well as extending the useful life thereof.

The present invention having been thus described with particular reference to the illustrated embodiments thereof, it will be obvious that various changes and modifications may be made therein without departing from the spirit of the present invention as defined herein.

What is claimed is:

1. A garment steamer comprising:

a base having a fluid heating assembly;

a fluid container in separable fluid communication with said fluid heating assembly;

a hose in separable fluid communication with said heating assembly;

a rod telescopically connected to said base;

a hanger being connected to said rod to collapsibly cooperate therewith, wherein said fluid heating assembly has a fluid inlet for receiving fluid from said fluid container, a boiler for receiving said fluid from said fluid inlet and for boiling said fluid, and fluid outlet for receiving a portion of said fluid that is vaporized by said boiling and for conveying said vaporized fluid through said hose, thereby allowing a user to control the emission of said vaporized fluid, wherein said hose cooperates with an attachment to provide a vapor emitting effect, wherein said attachment has an ionic assembly for generating and emitting ions and/or ozone of different polarity and/or intensity.

2. A garment steamer comprising:

a base having a fluid heating assembly;

a fluid container in separable fluid communication with said fluid heating assembly;

a hose in separable fluid communication with said fluid heating assembly;

a rod being connected to said base to telescopically extend therefrom;

a hanger being connected to said rod to collapsibly cooperate therewith; and an ionic assembly for generating and/or emitting ions and/or ozone.

3. The garment steamer of claim 2, wherein said ionic assembly has an ion and/or ozone generator for generating ions and/or ozone and an ion and/or ozone emitter operatively connected with said an ion and/or ozone generator for emitting said ions and/or ozone.

4. The garment steamer of claim 2, wherein said ionic assembly has a UV light source for producing and emitting ions and/or ozone.

5. The garment steamer of claim 3, wherein said fluid heating assembly has a fluid inlet for receiving a fluid from said fluid container, a boiler for receiving said fluid from said fluid inlet and for boiling said fluid, and a fluid outlet for receiving a portion of said fluid that is vaporized by said boiling and for conveying said vaporized fluid through said hose, thereby allowing a user to control the emission of said vaporized fluid.

6. The garment steamer of claim 5, wherein said hose selectively cooperates with a variety of different attachments to provide a variety of different vapor emitting effects.

7. The garment steamer of claim 6, wherein said ion and/or ozone generator generates ions and/or ozone of different polarity and/or intensity.

8. The garment steamer of claim 6, wherein said ion and/or ozone emitter emits said ions and/or ozone of different polarity and/or intensity.

9. The garment steamer of claim 8, wherein said ion and/or ozone emitter is situated to infuse or introduce ions and/or ozone into said vaporized fluid.

10. The garment steamer of claim 8, wherein said ion and/or ozone emitter is situated to infuse or introduce ions and/or ozone into a garment supported by said hanger.

11. The garment steamer of claim 2, wherein said rod is telescopically received and retained in said base.

12. The garment steamer of claim 2, wherein said rod is separable from said base and has a stand.

13. The garment steamer of claim 12, wherein said stand is integral with said rod to collapsibly cooperate therewith to enable said rod to stand alone separate from said base, and to cooperate with said base such that said base serves as a support for said rod.

14. The garment steamer of claim 2, wherein said hanger is slidable along said rod such that said hanger can be selectively positioned at any height along said rod.

15. A garment steamer comprising:

a base having a fluid heating assembly;

a fluid container in separable fluid communication with said fluid heating assembly;

a telescoping rod;

a hanger integral with said rod;

a stand separable from said rod; and an ionic assembly having an ionic generator.

* * * * *